US006070996A

United States Patent [19]

McCollum

[11] Patent Number: 6,070,996

[45] Date of Patent: Jun. 6, 2000

[54] PIVOTABLE STANCHION ASSEMBLY

[76] Inventor: Robert W. McCollum, 3600 Vista Ridge Dr. W., Mobile, Ala. 36693

[21] Appl. No.: 09/137,990

[22] Filed: Aug. 21, 1998

[51] Int. Cl.[7] ..... F21S 6/00

[52] U.S. Cl. ..... 362/431; 362/413; 362/414; 439/376; 439/928

[58] Field of Search ..... 362/410, 413, 362/414, 431, 226; 439/31, 165, 213, 376, 534, 928

[56] References Cited

U.S. PATENT DOCUMENTS

| | | | |
|---|---|---|---|
| Re. 26,995 | 12/1970 | Guggemos | 362/431 |
| 1,603,884 | 10/1926 | Amberg | 439/341 |
| 2,174,442 | 9/1939 | Haggar | 439/376 |
| 2,210,603 | 8/1940 | Shaw | 439/341 |
| 3,355,847 | 12/1967 | Pratt | 362/431 |
| 3,742,428 | 6/1973 | Rathband | 439/341 |
| 4,799,896 | 1/1989 | Gaynor et al. | 439/232 |
| 4,827,389 | 5/1989 | Crum | 362/431 |
| 4,941,840 | 7/1990 | Okada | 439/376 |
| 5,104,331 | 4/1992 | Goble | 439/341 |
| 5,476,392 | 12/1995 | Inaba et al. | 439/376 |
| 5,632,553 | 5/1997 | Huang | 362/410 |

*Primary Examiner*—Alan Cariaso
*Attorney, Agent, or Firm*—Kenneth L Tolar

[57] ABSTRACT

A pivotable light stanchion assembly includes an upper stanchion having a light at a top end and lower stanchion member which are detachably coupled with a pair of socket members. A first socket is attached to the lower stanchion and includes a plurality of receptacles in electrical communication with a power source. The opposing socket member is attached to the upper stanchion and includes a plurality of male prongs coupled with a light member at a distal end of the upper stanchion member. The socket members are pivotally joined so that the upper stanchion member may be pivoted downwardly relative to the lower stanchion member thereby disabling power to the light while allowing the light to be accessed from ground level.

8 Claims, 3 Drawing Sheets

PIVOTABLE STANCHION ASSEMBLY

BACKGROUND OF THE INVENTION

The present invention relates to a pair of pivotable electrical sockets for joining upper and lower stanchion members whereby the upper stanchion member may be pivoted downwardly so that a light mounted thereon is accessible at ground level.

DESCRIPTION OF THE PRIOR ART

Various industrial plants, vessels and similar public locations include walkways which are typically illuminated with stanchion mounted lights adjacent thereto. When a light on a given stanchion bums out, a worker must climb a railing or a ladder which is dangerous. Also, as a precaution, electrical power to the light socket must be disabled, usually by deactivating a designated circuit breaker switch. However, other lights are often wired to the same circuit resulting in all of the lighting in a given area being disabled. Accordingly, the process of changing a stanchion mounted light is dangerous, time consuming and inconvenient.

The present invention provides a uniquely configured device for pivotally coupling two stanchion members so that the upper stanchion member may be pivoted downwardly relative to the lower stanchion member allowing a user to safely access the light from ground level. In addition, when the upper stanchion is pivoted downwardly, electrical power to the light is immediately disabled.

Although various lighting devices exist in the prior art, none have the unique features and advantages of the present invention. For example, U.S. Pat. No. 5,476,392 issued to Napa et al relates to a connector device including a female connector fixedly mounted on a first base body and a male connector mounted on a second base body which is swingable about a rotatable axis relative to the first base body.

U.S. Pat. No. 5,104,331 issued to Goble relates to a damage resistant latching electrical connector.

U.S. Pat. No. 4,799,896 issued to Gainor et al relates to socket for compact flourescent lamps.

U.S. Pat. No. 3,742,428 issued to Rathban relates to bulb holders.

U.S. Pat. No. 2,210,603 issued to Shaw relates to an electrical socket adaptor.

U.S. Pat. No. 1,603,884 issued to Amber relates to a lighting fixture.

As indicated above, no devices exist in the prior art that even remotely relate to a pair of pivotable electrical sockets adapted to be coupled with a pair of stanchion members. The present invention allows a user to pivot an upper stanchion downwardly to access the light at ground level while simultaneously disabling power thereto.

SUMMARY OF THE INVENTION

The present invention relates to a pivotable stanchion assembly comprising first and second sockets joined with a hinge assembly. The hinge assembly includes a pair of parallel L-shaped arms extending from the first socket, the L-shaped arms forming a space therebetween. An L-shaped hinged member extends from the second socket member and is disposed between the two L-shaped arms. The hinge member is joined to the arms with a rivet allowing a first socket to pivot relative to the second socket. Each socket includes an internally threaded, open bottom end for threadedly engaging an externally threaded pipe or stanchion member. A first socket is secured to a lower stanchion and includes a plug member having a plurality of receptacles on its upper surface. The plug member is wired to an external power source. The second socket is attached to an upper stanchion member and includes a plug member having a plurality of electrical prongs on its upper surface in communication with a light member at a distal end of the upper stanchion. The prongs are spaced and dimensioned to be received within the receptacles on the first socket's plug member. When the second socket is invertably pivoted and superimposed on the first socket, the prongs seat within the receptacles to establish communication between the light and power source. When performing maintenance such as replacing the light, the upper stanchion component may be easily pivoted downwardly whereby the light is accessible at ground level and electrical communication between the power source and light is simultaneously interrupted. It is therefore an object of the present invention to provide a light stanchion assembly in which an upper portion may be pivoted relative to a lower portion to assist a user in performing maintenance thereon.

It is yet another object of the present invention to provide a light stanchion assembly which allows a user to quickly and conveniently disconnect electricity to a light mounted thereon.

It is yet another object of the present invention to provide a light stanchion assembly that is easy to use and inexpensive to manufacture. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
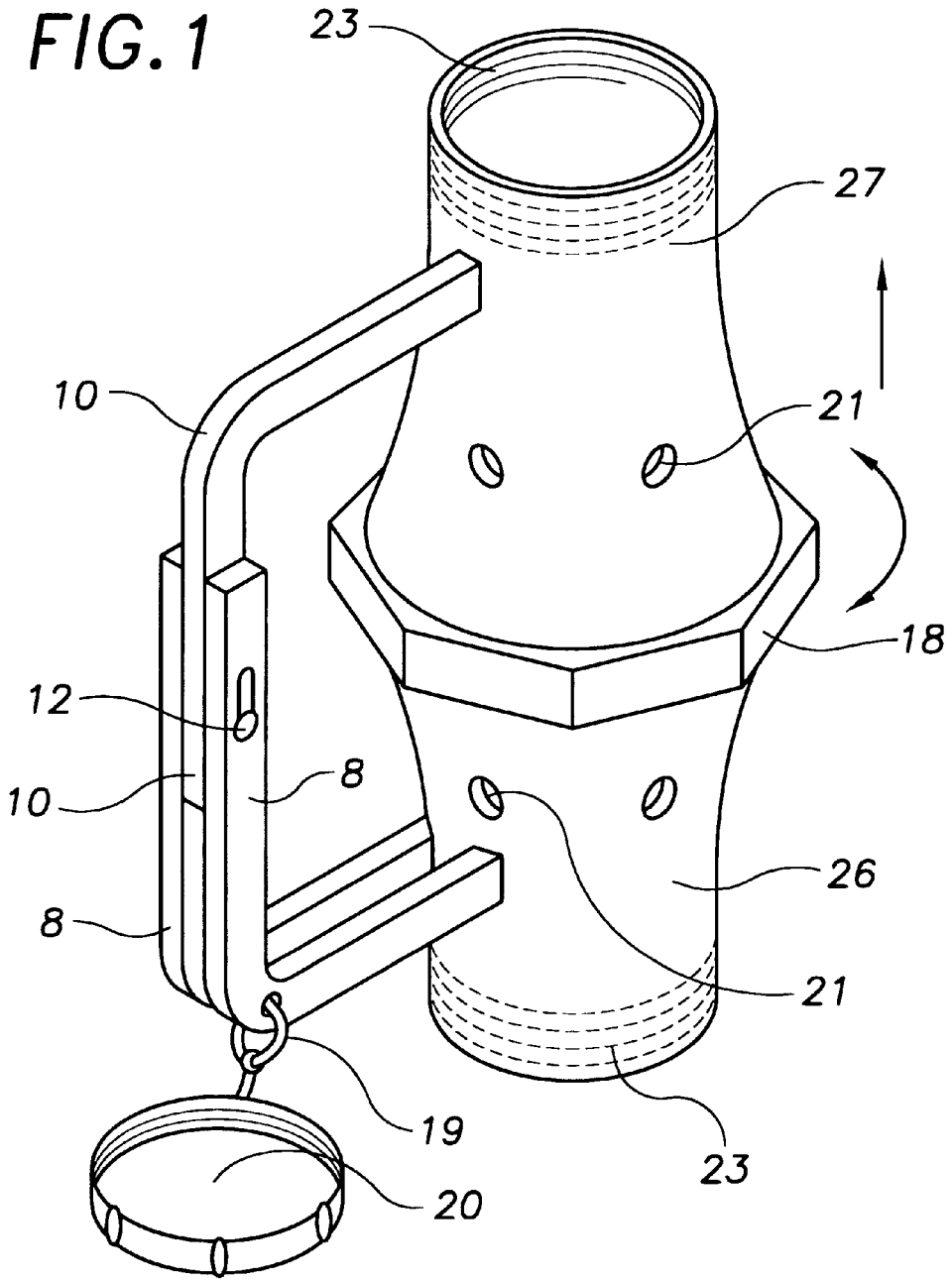
FIG. 1 is a perspective view of the inventive device with the second socket in an inverted, superimposed position.
Figure 3:
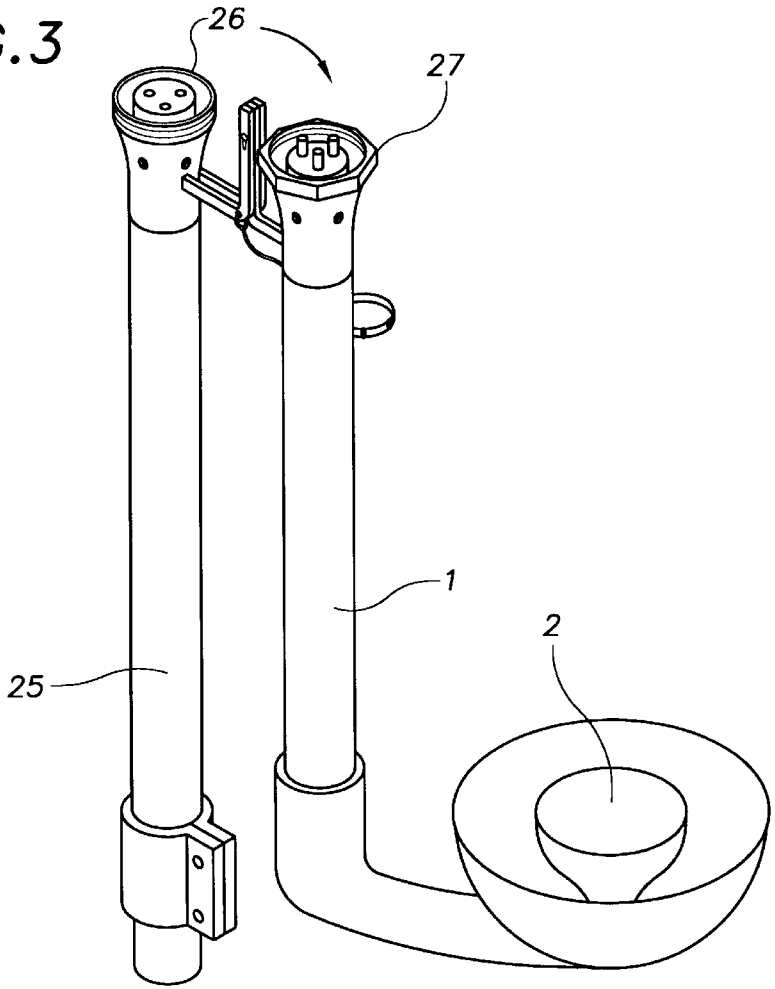
FIG. 3 depicts the upper stanchion pivoted downwardly relative to the lower stanchion.
Figure 2:
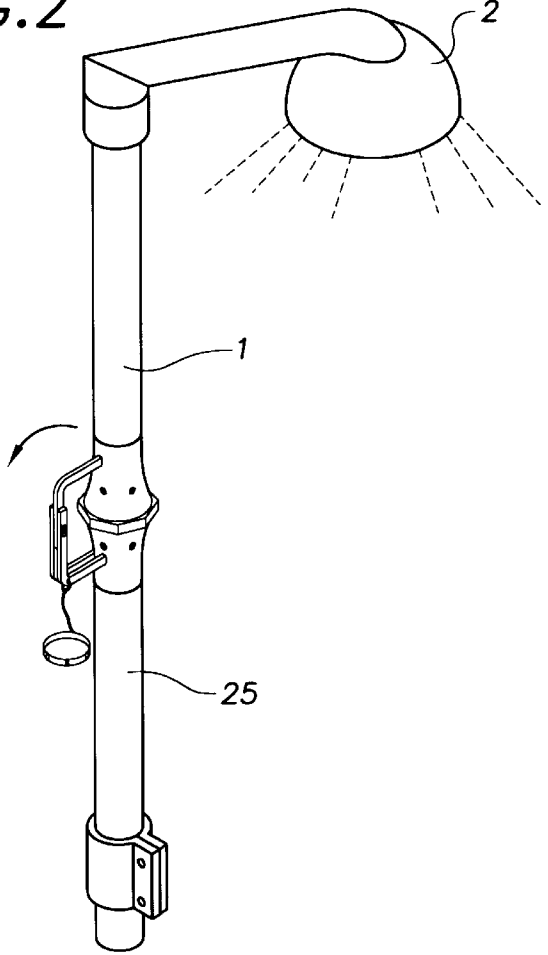
FIG. 2 depicts the device attached to upper and lower light stanchions.
Figure 4:
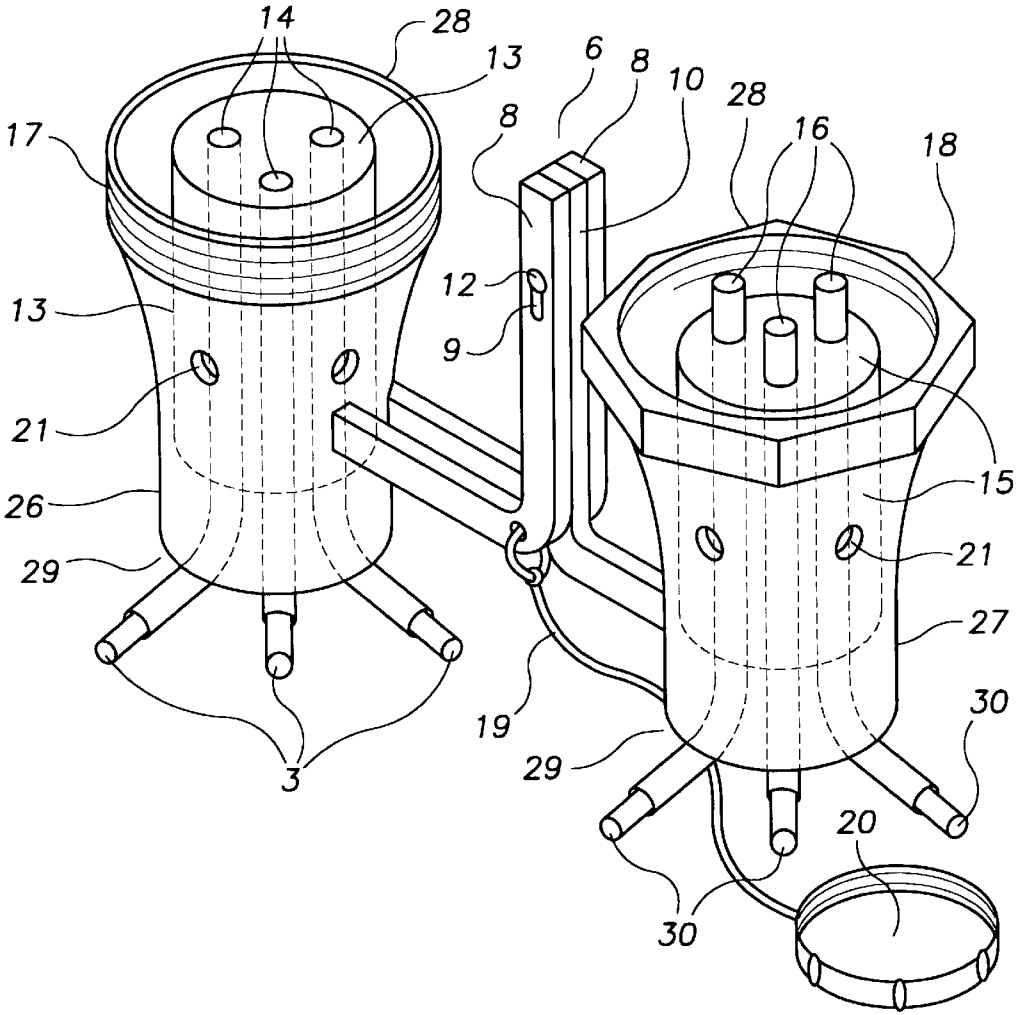
FIG. 4 is a perspective view of the inventive device pivoted to an open position.

Referring now to FIGS. 1 through 4, the present invention relates to a pivotable stanchion assembly. The device is designed to electrically and mechanically interconnect an upper stanchion member 1 to a lower stanchion member 25. The upper stanchion includes a light 2 at a distal end with wiring 30 connected thereto while the lower stanchion includes wiring 3 which is connected with a power source such as a conventional electrical circuit in a building or a vessel.

The device comprises first 26 and second 27 interconnected sockets each having open top 28 and bottom 29 ends. The sockets are joined with a hinge assembly 6 allowing either socket member to move between a juxtaposed, upright position and an inverted, superimposed position relative to the other socket member. The hinge assembly includes a pair of parallel L-shaped arms 8 extending from a first socket, the arms defining a space therebetween. Each arm has an elongated slot thereon 9. The second socket includes an L-shaped hinge member 10 disposed between the L-shaped arms on the opposing socket. The hinge member includes a rivet 12 on each side thereof, each of which is slidably received within a slot to attach the hinge member to the arms. The rivet/slot assembly allows a first socket to move a predetermined distance toward and away from a second socket while being pivotable relative thereto.

The bottom end of each socket includes an internally threaded portion 23 for threadedly engaging a stanchion member or pipe. Each socket member has a plug member received therein, the upper surface of which is adjacent its top end. A first plug member 13 includes a plurality of electrical receptacles 14 on its upper surface attachable to the power source wiring. The plug member 15 within the opposing socket includes a plurality of prongs 16 for coupling with the light wiring. The receptacles are spaced and dimensioned to receive the prongs when the second socket is inverted and superimposed on the first socket as depicted in FIG. 1.

The top ends of the two sockets are securely joined with a conventional union coupling. The first socket includes an externally threaded portion 17 adjacent its top end for engaging a coupling member 18 on the top end of the opposing socket to securely retain the upper stanchion in an upright position.

Attached to one of the L-shaped arms or the hinge member is a cord 19, wire, string or similar means. Secured to a distal end of the cord is a threaded cap 20 for threadedly engaging the top end of the first socket to prevent shock or electrocution when the plug members are exposed and to protect the receptacle from moisture and other contaminants. The sockets also include one or more screws 21 for securing the plugs therein.

Accordingly, each socket member is secured to an end of a stanchion member. The upper stanchion is pivoted to an upright position until its socket is superimposed on the lower stanchion socket thereby establishing electrical communication between the power source and light. The top ends are joined using the union coupling to retain the upper stanchion in an upright position. To replace the light or to perform similar maintenance, a user unthreads the coupling member and lifts the upper stanchion slightly to remove the electrical prongs from the corresponding receptacles thereby disabling power to the light. The upper stanchion is then pivoted downwardly relative to the lower stanchion member until the light is readily accessible at ground level. If necessary, the cap member may be placed onto the top end of the lower stanchion socket to cover the receptacle.

The socket members according to the present invention are preferably manufactured with plastic, nylon, Teflon™ or similar materials. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A pivotable stanchion assembly comprising:

a lower stanchion with a first socket member coupled to an end thereof, said first socket member in electrical communication with a power source;

an upper stanchion having an upper and lower end with a light on the upper end and a second socket member attached to the lower end, said second socket member in electrical communication with said light and pivotally attached to said first socket member with a hinge means whereby the upper stanchion and second socket member are movable between a juxtaposed, upright position and an inverted, superimposed position relative to the lower stanchion and first socket member;

said first and second socket members each including a mating electrical plug received therein that matably engage when the second socket member is inverted and superimposed on the first socket member to establish electrical communication between said light and power source whereby said upper stanchion is pivoted downwardly relative to the lower stanchion to disable power to said light and so that said light is accessible at groynd level.

2. A device according to claim 1 wherein the first socket includes an externally threaded portion for threadedly engaging an internally threaded coupling member on said second socket member to securely retain said sockets in the superimposed position.

3. A device according to claim 1 further comprising a cap member removably attached to said first socket to cover said electrical plug received therein.

4. A device according to claim 3 wherein said hinge means includes a pair of parallel, L-shaped arms extending from the first socket;

an L-shaped hinge member disposed between and pivotally secured to each of said arms.

5. A device according to claim 4 wherein said arms each further include a slot, each slot for slidably receiving a rivet on one of two opposing sides of said hinge member allowing said second socket to move toward and away from said first socket when superimposed thereon and to pivot relative thereto.

6. A device according to claim 5 wherein each of said sockets include a fastener means for securely retaining said plug members therein.

7. A pivotable stanchion assembly comprising:

a lower stanchion with a first socket member coupled to an end thereof;

an upper stanchion having an upper and lower end with a light on the upper end and a second socket member attached to the lower end, said second socket member pivotally attached to said first socket member with a hinge means, said hinge means including a pair of parallel, L-shaped arms extending from the first socket member and an L-shaped hinge member disposed between and pivotally secured to said arms whereby the second socket is movable between a juxtaposed, upright position and an inverted, superimposed position relative to the first socket;

said first and second socket members each having a mating electrical plug received therein, said first socket member plug electrically connected to said light, said second socket member plug electrically connected to a power source, said plugs matably engaging when the second socket member is inverted and superimposed on the first socket member to establish electrical communication between said light and power source whereby said upper stanchion is pivoted relative to the lower stanchion to disable power to said light and so that said light is accessible at ground level.

8. A device according to claim 7 wherein said arms each further include a slot, each slot for slidably receiving a rivet on one of two opposing sides of said hinge member allowing said second socket to move toward and away from said first socket when superimposed thereon and to pivot relative thereto.

* * * * *